US005147238A

United States Patent [19]

Kelley et al.

[11] Patent Number: 5,147,238

[45] Date of Patent: Sep. 15, 1992

[54] TAP DANCE DOLL

[75] Inventors: William J. Kelley, Torrance; Howard R. Stern, Redondo Beach, both of Calif.

[73] Assignee: Mattel, Inc., El Segundo, Calif.

[21] Appl. No.: 611,998

[22] Filed: Nov. 9, 1990

[51] Int. Cl.[5] ..... A63H 3/20; A63H 3/28

[52] U.S. Cl. ..... 446/330; 446/268; 446/338; 446/365; 446/377; 446/297

[58] Field of Search ..... 446/268, 317, 325, 326, 446/330, 338, 339, 340, 365, 366, 367, 373, 375, 377, 384, 390, 391, 297

[56] References Cited

U.S. PATENT DOCUMENTS

| | | | |
|---|---|---|---|
| 681,974 | 9/1901 | Purvis | 446/338 |
| 1,284,381 | 11/1918 | Levin | 446/390 X |
| 1,483,127 | 2/1924 | Starbuck . | |
| 1,586,444 | 5/1926 | Griewank | 446/338 |
| 1,782,576 | 11/1930 | MacGregor | 446/373 |
| 3,094,331 | 6/1963 | Greene | 446/330 X |
| 3,421,258 | 1/1969 | Gardel et al. . | |
| 3,700,384 | 10/1972 | Gardel et al. | 446/330 X |
| 3,724,125 | 4/1973 | Goldfarb et al. | 446/330 |
| 4,545,775 | 10/1985 | Kim | 446/299 |
| 4,676,764 | 6/1987 | Yeu . | |

FOREIGN PATENT DOCUMENTS

| | | | |
|---|---|---|---|
| 560869 | 7/1958 | Canada | 446/377 |
| 1017031 | 11/1952 | France | 446/377 |
| 168954 | 10/1959 | Switzerland | 446/317 |
| 649723 | 1/1951 | United Kingdom | 446/377 |

*Primary Examiner*—Robert A. Hafer
*Assistant Examiner*—Sam Rimell

[57] ABSTRACT

A doll including a torso, a pair of arms rotatably joined to the torso, a pair of legs rotatably fixed to the torso, a pair of feet rotatably fixed to the legs, apparatus within each of the legs for raising the feet, and apparatus actuated by movement of the arms for actuating the apparatus within each of the legs for raising the feet.

3 Claims, 4 Drawing Sheets

TAP DANCE DOLL

BACKGROUND OF THE INVENTION

1. Field of the Invention

This invention relates to toys and, more particularly, to a toy doll which simulates the movements of a person tap dancing.

2. History of the Prior Art

There have been many dolls devised over the years which have included mechanical arrangements for simulating movements of humans or animals. Attempts at such simulation have ranged from the crude to the much more sophisticated. In general, such toys have been capable of simulating a single action of the particular living being. For example, a dancing doll might simulate the movement of a leg of a person while a talking doll might simulate the movement of a mouth and include some sound mechanism. Some dolls have been capable of more than one mechanical action; but, in general, these dolls have been sensitive to handling and easily broken.

SUMMARY OF THE INVENTION

It is, therefore, an object of the present invention to provide a doll capable of simulating simultaneously a number of the movements of a tap dancer.

It is another, more specific, object of the present invention to provide a toy doll capable of simultaneously tapping its shoes while moving its hips, arms, and head in motions simulating those of a tap dancer.

These and other objects of the present invention are realized in a doll comprising a torso, a pair of arms rotatably joined to the torso, a pair of legs rotatably fixed to the torso, a pair of feet rotatably fixed to the legs, means within each of the legs for raising the feet, and means actuated by movement of the arms for actuating the means within each of the legs for raising the feet.

These and other objects and features of the invention will be better understood by reference to the detailed description which follows taken together with the drawings in which like elements are referred to by like designations throughout the several views.

DETAILED DESCRIPTION OF THE INVENTION

Figure 1:
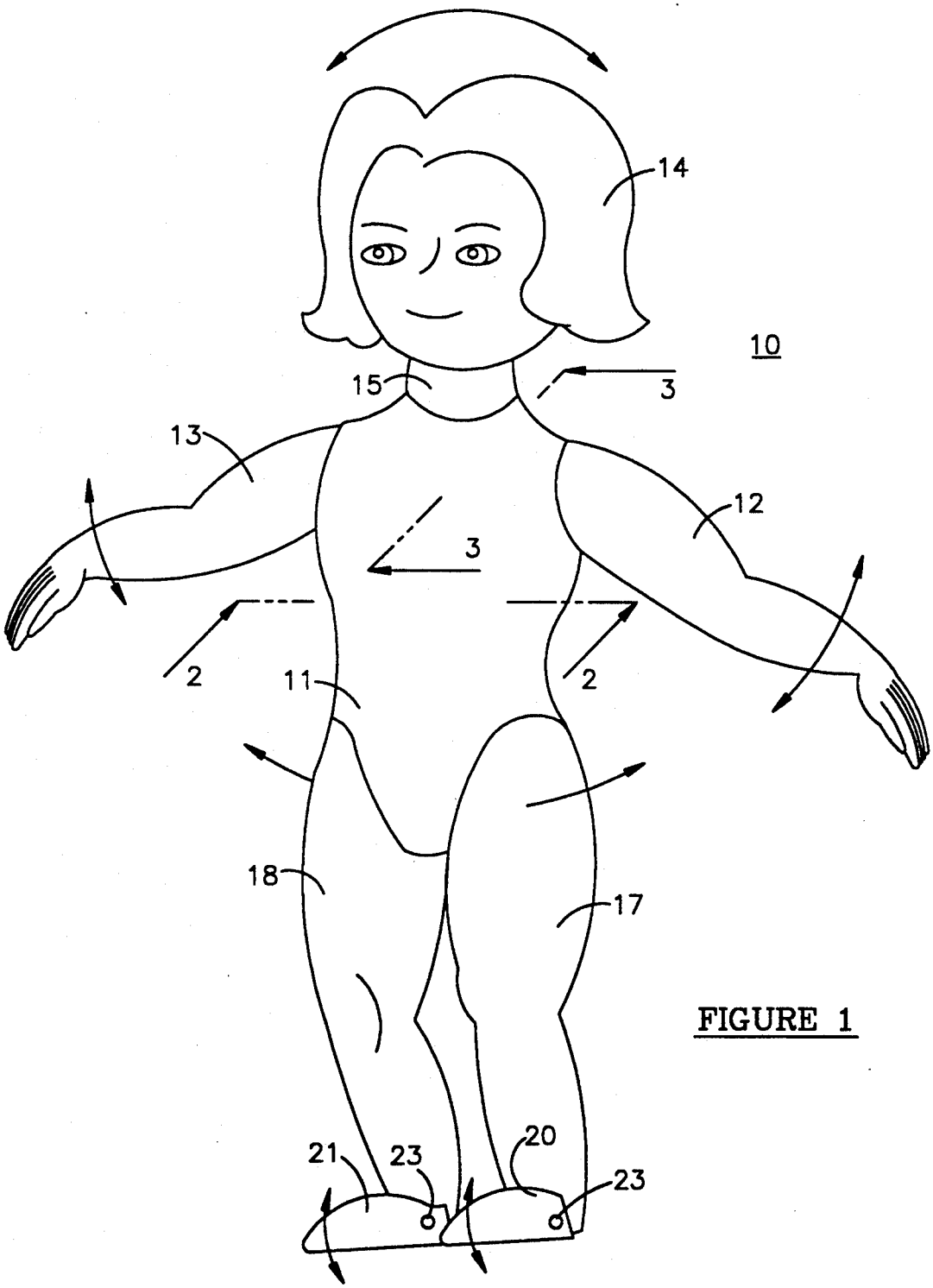
FIG. 1 is an isometric drawing of a doll constructed in accordance with the present invention.

Referring now to FIG. 1, there is illustrated a toy doll 10 constructed in accordance with the invention. The doll 10 has a main body or torso portion 11, a pair of arms 12 and 13, a head 14 supported by a neck 15, a pair of legs 17 and 18, and feet 20 and 21. A mechanism (not shown in FIG. 1) is included within the main body portion 11 which causes the doll 10 to move individual parts either individually or simultaneously. The mechanism is adapted to caused the feet 20 and 21 to appear to tap against a horizontal surface upon which the doll 10 is positioned at the same time that sounds simulating the tapping are emitted. The mechanism is actuated by the arms 12 and 13 which move as illustrated by the arrows in FIG. 1 so that the doll 10 appears to be balancing while tapping. The internal mechanism also causes the head 14 to rock from side to side relative the shoulders of the doll 10 when the legs of the doll are moved where they join the torso to simulate the swaying motion of the head of a human when tap dancing. The mechanism is arranged to control the movement of the legs 17 and 18 where they join the torso 11 so that the hips may be made to appear to sway as the doll 10 dances. These individual movements are thus such that when coordinated with the other possible simultaneous movements, the doll 10 appears to be tap dancing.

Figure 2:
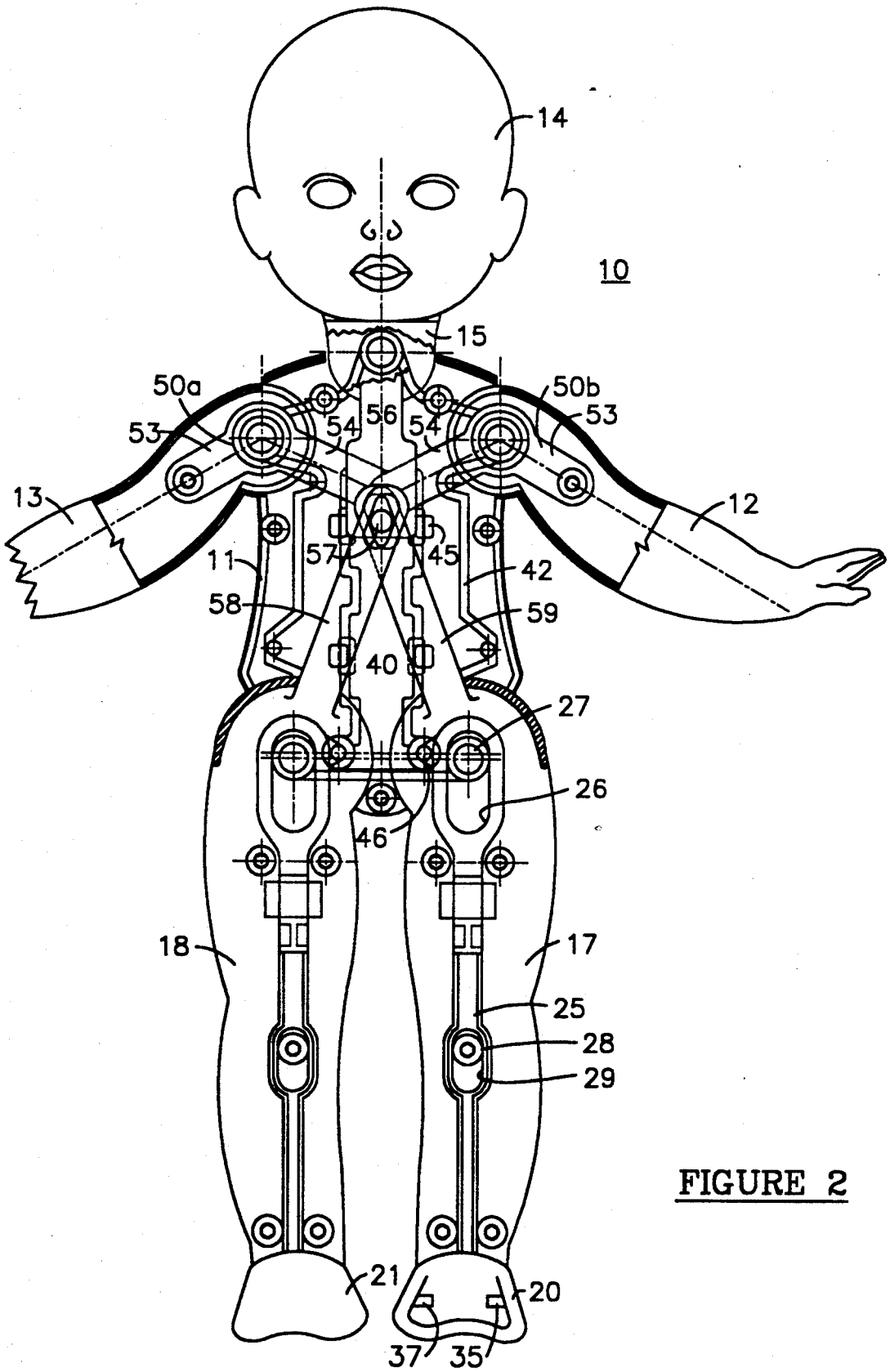
FIG. 2 is a front cross-sectional view of the doll illustrated in Figure 1 taken along the line 2—2.
Figure 3:
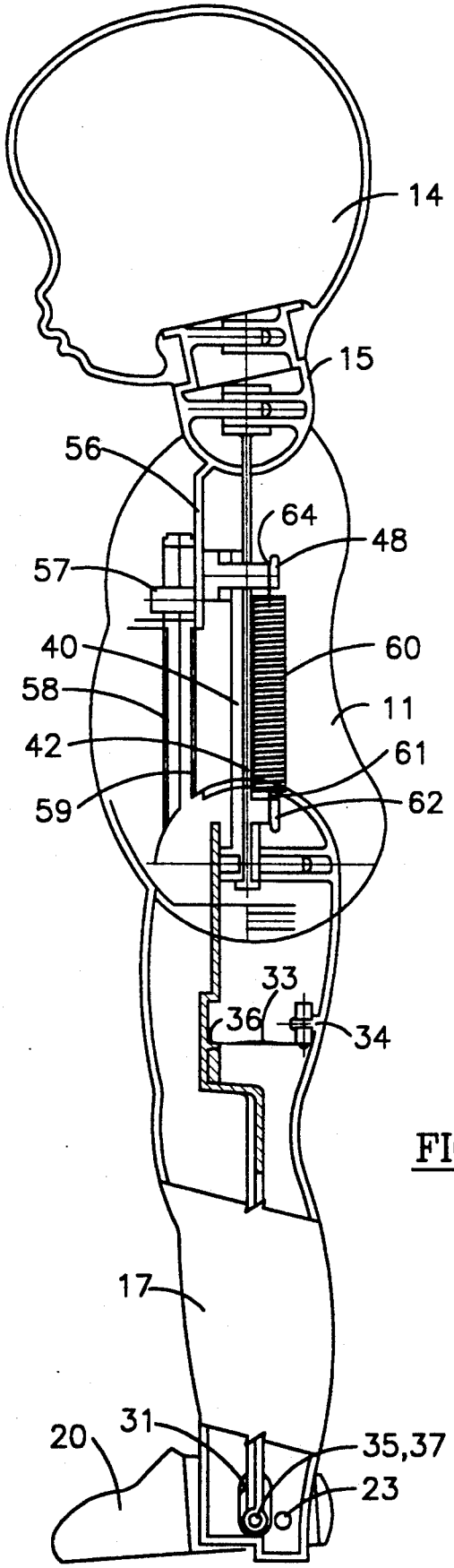
FIG. 3 is a side cross-sectional view of the doll illustrated in FIG. 1 taken along the line 3—3.

FIG. 2 is a cross-sectional view of the doll 10 taken along the line 2—2 of FIG. 1. FIG. 3 is a cross-sectional view of the doll 10 taken along the line 3—3 of FIG. 1. Both of these FIGS. should be referred to in the following description in order to understand the operation of the internal mechanism referred to above.

As may be seen in FIG. 2, each of the legs 17 and 18 may be constructed as a hollow shell from a moldable plastic material many of which are well known in the art. From the interior of the shell a number of pegs or pins project inwardly to maintain the two halves of the shell forming the legs 17 and 18 in place and to provide positioning mounts for portions of the mechanism. Each of the legs 17 and 18 has running vertically through its interior a drive link 25. The drive link 25 may also be formed of moldable plastic material such as styrene and is held in its vertical position by an upper slot 26 which fits over a pin 27 projecting from the interior of the shell which forms the leg 17 or 18. The slot 26 in the drive link 25 is adapted to allow the drive link 25 to slide up and down within the leg 17 or 18. A second pin 28 joined or molded to the interior of the shell of the leg 17 or 18 fits within a second slot 29 also adapted to allow the drive link 25 to slide up and down within the leg 17 or 18.

Each of the feet 20 and 21 may be formed in the shape illustrated of a moldable plastic material. Each of the feet 20 and 21 has a hollow interior at the upper rear into which the lower portion of the associated leg 17 or 18 extends. Each of the feet 20 and 21 connects to its associated leg 17 or 18 by a pair of pins molded to the interior surface of the associated foot 20 or 21 and projecting horizontally inwardly to fit into holes 23 in the opposite sides of the shell of the associated leg 17 or 18.

The drive link 25 within each leg 17 and 18 extends into the opening in the associated one of the feet 20 and 21. Each drive link 25 is rotatably connected to the associated foot 17 or 18 by a pair of pins 35 and 37 extending outwardly from the lower end of the drive link 25 and adapted to fit within holes 29 (shown in FIG. 1) in the feet 20 and 21. As may be seen the pins 35 and 37 project through slots 31 in the lower portion of the legs 17 and 18 so that they fit into the holes 29 and are free to move up and down with the movement of the drive link 25.

When the drive link 25 moves up and down with respect to the leg 17 or 18 with which it is associated, the pins 35 and 37 pull upwardly on the associated one of the feet 20 or 21. Since each of the feet 20 and 21 is rotatably fixed to the rear of the leg 17 or 18 of the doll 10 at the holes 23, the upward movement of the drive link 25 causes the associated foot 20 or 21 to rotate upwardly at its toe about the pivot point at the hole 23. When the drive link 25 is driven downwardly, the associated foot 20 or 21 moves downwardly and appears to tap upon any surface upon which the doll 10 is positioned.

Positioned centrally within the shell which forms each of the legs 17 and 18 is a clicker 33. The clicker 33 may be an L-shaped flat piece of metal. The short end of the L is held firmly in place within the shell of the leg 17 or 18 by a projection 34 from the interior of the shell of the leg 17 or 18. The horizontally-projecting portion of the clicker 33 is a flat rectangular piece constructed of hard metal dimpled upwardly in its central portion. Such clickers 33 are well known, and when bent at the dimpled portion provide a clicking sound. The clicker 33 is just long enough to engage a shelf 36 formed in the drive link 25 when the drive link 25 is at its lowest position. When the drive link 25 is raised, the clicker 33 is forced upwardly at its left end (as shown in FIG. 3), causing it to emit a clicking sound. When the drive link is lowered to its lowest position, the clicker 33 is released causing it to again emit a click. Since the drive link moving upward causes the attached foot 20 or 21 to rise at the toe, the clicker 33 clicks as a foot rises. Since the drive link moving downward causes the attached foot 20 or 21 to fall at the toe, the clicker 33 clicks as a foot falls and appears to hit the floor. If the two clickers 33 and the shelves in the drive links 25 are positioned at slightly different positions vertically, then the clicks made by the two clickers 33 as the drive links 25 move up and down will be slightly separated in time as are the clicks made by a human tap dancer.

The torso 11 of the doll 10 is preferably formed as a shell of molded plastic material in a manner well known to those skilled in the art. Within the torso 11 of the doll 10 is movably positioned a second drive link 40. The drive link 40 is held to slide up and down by a frame 42. Each of the drive link 40 and the frame 42 may be constructed of a moldable plastic material in a manner well known to those skilled in the art. The frame 42 is held fixedly in position within the shell of the torso 11 by a number of pins 44 projecting from the interior of the shell of the torso 11 through holes in the frame 42 adapted to mate therewith. The drive link 40 is slidably held by L-shaped projections 45 from the frame 42.

At the lower end of the drive link 40 are a pair of holes into which project a pair of pins 46, one of which extends horizontally from and is a part of each drive link 25. Each of the pins 46 is rotatably connected in the associated hole. When the drive link 40 moves downwardly, the pins 46 force each of the drive links 25 within the legs 20 and 21 downwardly. As pointed out, this causes both of feet 20 and 21 attached to the associated leg 17 or 18 to move downwardly at its toe and appear to tap. This also releases the clicker 33 so that it clicks as the toe moves downward and appears to hit the surface on which the doll is positioned. When the drive link 40 moves upward, the drive links 25 are both moved upward within the shells of the legs 17 and 18, raising the toes of the feet 20 and 21, and overcentering the clicker 33 so that it emits a noise.

As may be seen in FIG. 2, each of the legs 17 and 18 fits into holes in the lower portion of the shell of the torso 11 in a ball and socket arrangement which is typical of toy dolls. However, since each of the legs is attached to a forwardly projecting pin 27 which lies within the slot 26, the legs 17 and 18 are effectively allowed to move only essentially parallel to one another and essentially in a plane which matches the plane of the cross section in which FIG. 3 lies. Thus, the doll 10 may have its legs 17 and 18 moved with respect to its torso 11 in a motion in which the legs move from side to side essentially in the form of opposing sides of a parallelogram. This motion is very like the rocking motion a tap dancer makes at the hips while dancing.

At its upper end of the second drive link 40 a slot 47 is molded. A cylindrical pin 48 rides within the slot 47. A pair of links **50*a* and 50*b* each have two projecting portions 53 and 54. Each of the portions 53 is fixed within one of the arms 12 or 13. The portion 54 of the link 50*a* has a slot molded in its inner end. This slot loosely encloses the pin 48. The portion 54 of the link 50*b* has a circular hole molded in its inner end which loosely encloses the pin 48. The two arms 12 and 13 join the torso 11 in a typical ball and socket arrangement used for dolls. Consequently, each arm 12 and 13 is free to rotate within the socket at the torso 11. However, the links 50*a* and 50*b* essentially fix the arm movement so that it may only be in directions shown by the arrows in FIG. 4 and is constrained to remain within essentially the plane of the cross section in which FIG. 2** is described.

Figure 4:
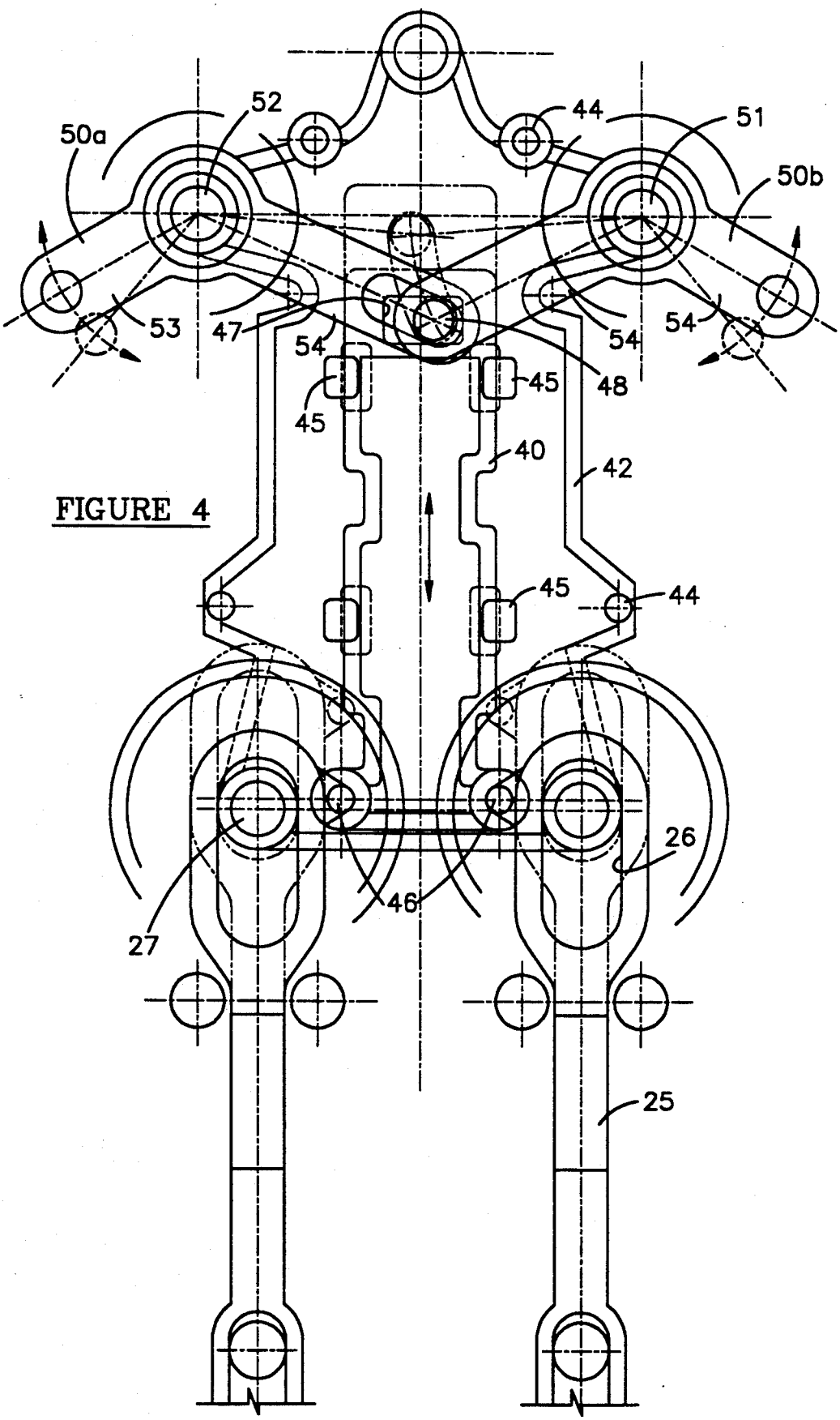
FIG. 4 is a detail of the illustration shown in FIG. 2.

When the drive link 40 moves upward into the position illustrated by the dotted lines to the top of link 40 in FIG. 4, the pin 48 is moved upward by the slot 47 along the dotted arc to the final position shown as a dotted circle in FIG. 4. The pin 48 forces each of the portions 54 upward thereby causing the arms 12 and 13 to move downward. When the drive link 40 moves downward, the pin 48 is moved downward by the slot 47. The pin 48 forces each of the portions 54 downward thereby causing the arms 12 and 13 to move upward. Thus, as the drive link 25 raises to raise the toes of the feet 20 and 21, the arms of the doll 10 move downward. This is a motion which simulates the natural motion of a human executing a tap dance.

Finally, the head 14 of the doll 10 has a lower projecting portion which simulates the neck 15 and also forms a ball and socket joint with an opening in the upper portion of the torso 11. However, the head 14 is joined to the frame 42 by a pin 55 which allows the head 14 to move from side to side in a typical swaying fashion similar to the movement made by a dancer. A lever 56 depends from the head 14 and has a pin 57 extending therefrom. By linking the head at the pin 57 to the outside of each of the legs 17 and 18 by means of the extensions 58 and 59, the head 14 may be made to sway when the hips of the doll are moved from side to side relative to the position of the feet.

A coil spring 60 has a loop 61 at one end connected to a projection 62 molded in the back of the frame 42. An upper loop 64 of the coil spring 60 is fastened around the pin 48 and pulls down on it. The force exerted by the extended spring 60 tends to pull the second drive link 40 downwardly thereby raising the arms of the doll 11 in the normal at rest position. The doll may be placed in motion by positioning the feet 20 and 21 on a horizontal surface and forcing the arms 12 and 13 downwardly. This causes the pin 48 to raise the second drive link 40 thereby raising the lower drive links 25. Raising the lower drive links 25 raises the toes of each of the feet 20 and 21 and causes the clickers 33 to click. When the force on the arms 12 and 13 is released, the arms rise upwardly and the toes of the feet fall as the coil spring forces the pin 48 downward. The clickers 33 again sound approximately as the toes contact the horizontal surface.

Although the present invention has been described in terms of a preferred embodiment, it will be appreciated that various modifications and alterations might be made by those skilled in the art without departing from the spirit and scope of the invention. The invention should therefore be measured in terms of the claims which follow.

What is claimed is:

1. A movable figure toy comprising:

a torso;

a pair of arms;

means rotatably joining said arms to said torso;

a pair of hollow legs;

means rotatably joining said legs to said torso;

a pair of feet;

means rotatably joining said feet to the distal ends of said legs;

each of said legs further including drive links slidably mounted within said legs, one end of said drive links being pivotally mounted to said feet and the opposite end of said drive links including elongated slots for pivotable mounting to a pivot means positioned such that said drive links move through a center of rotation established by said means rotatably joining said legs to said torso; each said arms including extension portions extending into said torso and; connecting links connecting each said extension portions to said drive links in the legs so that when said arms are rotated, said connecting links actuate said drive links, causing said feet to simultaneously pivot.

2. The movable figure toy of claim 1 further comprising:

a head pivotally attached to said torso and means for pivotally connecting said head to said legs for pivoting said heads by pivotable movement of said legs.

3. The movable figure toy of claim 1 further comprising:

sounding means fixed within each of said legs and sound actuation means attached to said drive links so that movement of said drive links actuates said sounding means.

* * * * *